US012006804B2

(12) United States Patent
Abu-Khamsin et al.

(10) Patent No.: US 12,006,804 B2
(45) **Date of Patent: *Jun. 11, 2024**

(54) METHOD FOR RECOVERING HYDROCARBONS WITH AN ORGANIC SOLVENT INJECTION BLEND

(71) Applicant: KING FAHD UNIVERSITY OF PETROLEUM AND MINERALS, Dhahran (SA)

(72) Inventors: Sidqi A. Abu-Khamsin, Dhahran (SA); Khaled H. Al-Azani, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 18/472,683

(22) Filed: Sep. 22, 2023

(65) Prior Publication Data

US 2024/0011376 A1 Jan. 11, 2024

Related U.S. Application Data

(63) Continuation of application No. 16/530,430, filed on Aug. 2, 2019, now Pat. No. 11,795,796.

(51) Int. Cl.
*E21B 43/16* (2006.01)
*E21B 43/24* (2006.01)

(52) U.S. Cl.
CPC ..... *E21B 43/168* (2013.01); *E21B 43/164* (2013.01); *E21B 43/24* (2013.01)

(58) Field of Classification Search
CPC ..... E21B 43/168; E21B 43/164; E21B 43/24
See application file for complete search history.

(56) References Cited

U.S. PATENT DOCUMENTS 4,782,901 A 11/1988 Phelps et al.
4,800,957 A 1/1989 Stevens, Jr.
(Continued)

FOREIGN PATENT DOCUMENTS

CN 104832141 B 2/2018
WO 2014/138201 A2 9/2014

OTHER PUBLICATIONS

Hussain ; Enhanced Oil Recovery Using Supercritical Carbon Dioxide With and Without Co-solvents ; International Journal of Petroleum and Gas Engineering, vol. 2, No. 1 ; pp. 1-12 ; Apr. 2014; 12 Pages.

(Continued)

*Primary Examiner* — Silvana C Runyan
(74) *Attorney, Agent, or Firm* — Oblon, McClelland, Maier & Neustadt, L.L.P.

(57) ABSTRACT

A method for mitigating gas override in an hydrocarbon reservoir by increasing sweep efficiency and consequently improving incremental oil recovery is provided with at least one injection well, at least one production well, and an hydrocarbon reservoir. The injection well and the production well are in fluid communication with the hydrocarbon reservoir. An injection blend produced by mixing a displacement fluid with an organic solvent is transferred into the hydrocarbon reservoir through the injection well. Preferably, the displacement fluid is supercritical carbon dioxide and the organic solvent is triethyl citrate. The higher density and the viscosity of the injection blend are vital in reducing gravity override and improving sweep efficiency. A resulting injection blend is extracted from the production well and the organic solvent is separated. Since the organic solvent can be reused, the method of mitigating gas override can be financially and operationally beneficial.

9 Claims, 4 Drawing Sheets

(56) References Cited

U.S. PATENT DOCUMENTS

| | | | | |
|---|---|---|---|---|
| 4,828,032 | A | 5/1989 | Teletzke | |
| 4,899,817 | A | 2/1990 | Djabbarah | |
| 5,547,022 | A | 8/1996 | Juprasert | |
| 8,235,117 | B1 | 8/2012 | Hill et al. | |
| 9,033,033 | B2 | 5/2015 | Thomas et al. | |
| 9,267,364 | B2 | 2/2016 | Poindexter | |
| 2009/0236092 | A1 | 9/2009 | O'Brien | |
| 2011/0214859 | A1* | 9/2011 | Loveless | C09K 8/685 166/275 |
| 2015/0101808 | A1* | 4/2015 | Saini | C09K 8/805 166/308.1 |
| 2016/0153273 | A1* | 6/2016 | Nguyen | C09K 8/5758 166/243 |
| 2018/0087354 | A1 | 3/2018 | Acosta Ramirez et al. | |
| 2018/0258341 | A1 | 9/2018 | Al-Otaibi et al. | |

OTHER PUBLICATIONS

Lakatos, et al. ; Multifunctional Stimulation of Gas Wells Operating in Gas Cap over a Depleted Oil Reservoir ; Society of Petroleum Engineers : SPE International Conference and Exhibition on Formation Damage Control ; 2016 ; Abstract Only ; 3 Pages.

Turner ; From supercritical carbon dioxide to gas expanded liquids in extraction and chromatography of lipids ; Lipid Technology vol. 27, Issue 12 ; Dec. 10, 2015 ; 9 Pages.

* cited by examiner

METHOD FOR RECOVERING HYDROCARBONS WITH AN ORGANIC SOLVENT INJECTION BLEND

CROSS-REFERENCE TO RELATED APPLICATIONS

The present application is a Continuation of U.S. application Ser. No. 16/530,430, now allowed, having a filing date of Aug. 2, 2019.

BACKGROUND

Field of the Invention

The method of the present disclosure is related to the field of oil recovery from hydrocarbon reservoirs. More specifically, the present disclosure includes a process of injecting a blend made of a gas, such as carbon dioxide, and an organic solvent, such as triethyl citrate, into a subterranean oil reservoir for enhanced oil recovery.

Description of the Related Art

Oil in a subsurface reservoir is produced by the natural energy stored in the reservoir, and production is driven by one or more of the following: (i) expansion of oil and gas. (ii) liberation of vapor phase from liquid inside the reservoir, (iii) water encroachment from nearby aquifers, (iv) oil drainage due to gravity, and (v) compaction of unconsolidated formation. Continuous production and consequent depletion causes the subsurface pressure to drop such that the stored fluid energy begins to diminish. As a result, only a fraction of the quantity of oil within the hydrocarbon reservoir is generally recovered. In order to address these existing issues, different recovery techniques have been implemented either for maintaining the reservoir pressure or for improving the displacement of the oil from the geologic formation in which the reservoir is located. Water injection, thermal flooding, gas injection, miscible flooding or a combination of these techniques are generally used for maintaining reservoir pressure and improving the displacement of oil from subterranean geologic formations containing hydrocarbon reservoirs. In particular, the injection of hydrocarbon gases such as methane, ethane, propane, butane, or a mixture of these gases have been proven to be a viable oil recovery technique. Furthermore, the injection of non-hydrocarbon gases such as carbon dioxide, nitrogen, flue gas, air, or steam has also provided favorable results during oil recovery processes.

Gases such as carbon dioxide are used due to characteristics that can be beneficial in oil recovery. More specifically, in a supercritical state, carbon dioxide can be miscible with crude oil, e.g., by extracting nonpolar compounds from oil. Additionally, carbon dioxide can swell the oil, lower oil viscosity, decrease oil interfacial tension (IFT) with water, and alter the density of oil. Thus, injecting supercritical carbon dioxide into an oil reservoir is beneficial in improving the efficiency of oil displacement.

The density and viscosity of supercritical carbon dioxide is low compared to water and oil present within the oil reservoir. The difference in density and viscosity leads to gravity segregation, wherein the carbon dioxide rises to the top of the reservoir and flows towards the producing wells. Gravity segregation is notably seen in reservoirs with good vertical communication. Gravity override causes the injected gas to bypass a significant portion of the oil reservoir volume resulting in poor reservoir sweep efficiency, early breakthrough, and consequently a lower incremental oil recovery than otherwise anticipated. In particular, reservoir sweep efficiency is defined as the volume of the reservoir contacted by the injected fluid. Early breakthrough refers to the fluid injected into the oil reservoir breaking through to one or more of the production wells and appearing in the material produced from the well.

In order to address the issue of poor reservoir sweep by carbon dioxide, blocking agents such as foam, cross-linked polymers, and gels are commonly used. The blocking agents invade the high permeability zones of the oil reservoir and significantly reduce the pemeability to carbon dioxide. However, a blocking agent that can withstand high temperatures and high salinities of some oil reservoirs is yet to be identified. Moreover, the use of blocking agents is known to be effective in preventing viscous fingering and blocking thief zones rather than reducing gravity override. Viscous fingering is a condition whereby the interface of two fluids, such as oil and water, bypasses sections of reservoir as it moves along, creating an uneven, or fingered, profile. Fingering is a relatively common condition in reservoirs with water-injection wells. The result of fingering is an inefficient sweeping action that can bypass significant volumes of recoverable oil and, in severe cases, an early breakthrough of water into adjacent production wellbores. On the other hand, a thief zone is defined as an interval within the hydrocarbon-bearing formation that has a permeability much larger than the permeability of the rest of the formation.

Gravity override can be mitigated by increasing the density and/or viscosity of the injected supercritical carbon dioxide. Even though carbon dioxide thickeners such as polymers and small-molecule materials can be used for thickening purposes, operational issues may occur since all available carbon dioxide thickeners exist as solids at ambient conditions. Therefore, the available thickeners which have a powdery texture at ambient temperatures need to be dissolved in different solvents to form a viscous, concentrated, and easy-to-pump solution. The solution obtained by dissolving the thickener is then pumped into a carbon dioxide stream. Another disadvantage associated with thickener-blended supercritical carbon dioxide solutions is that the resulting solution tends to lose the increased density and viscosity when travelling through the reservoir due to polymer adsorption on the rock surfaces. Therefore, the need for a solvent that can produce a high density and high viscosity solution that remains in a single phase at reservoir conditions is clear.

Another technique used to mitigate gravity override is blending supercritical carbon dioxide with an alcohol such that the miscibility of carbon dioxide with reservoir oil is improved. Even though a solution with high density and viscosity can be obtained by blending supercritical carbon dioxide with alcohol, a significant amount of alcohol is required to achieve a significant increase in the density of supercritical carbon dioxide. For example, at a pressure of 3040 pounds per square inch absolute (PSLA) and a temperature of 89 centigrade (° C.), the maximum density of the solution consisting of supercritical carbon dioxide and ethyl alcohol is 0.767 gram/cubic centimeter (g/cm$^3$). However, in order to achieve the 0.767 g/cm$^3$ density, the solution requires 77 mole percent (mole %) of ethyl alcohol. An additional disadvantage related to the use of alcohol is that the high solubility of alcohol with the oil and water within the reservoir can deplete the characteristics of the carbon dioxide and alcohol solution. Moreover, the alcohol cannot be recovered readily due to its solubility in the oil.

A different technique used to mitigate gravity override involves dispersing nanoscale capsules into supercritical carbon dioxide. Each of the nanoscale capsules contains a densifying liquid within a shell, wherein the shell consists of a wall containing a carbon dioxide-philic compound. The densifying liquid can be, but is not limited to, toluene, crude oil, ester, silicone oil, alcohols, acetone, or a combination thereof. The wall of each of the nanoscale capsules will dissolve in the supercritical carbon dioxide releasing the densifying liquid. Even though the density of the supercritical carbon dioxide is altered, the densifying liquid used to alter the density of supercritical carbon dioxide cannot be recovered.

It is therefore an objective of the present disclosure to use a blend of an organic solvent, such as triethyl citrate, with a displacing fluid, such as supercritical carbon dioxide, to provide a blend with high density and thereby minimize the effect of gravity override and increase the volume of the reservoir contacted by the resulting blend upon injection into the hydrocarbon reservoir.

Another objective of the present disclosure is to provide a blend having increased viscosity and thereby reduce the viscosity contrast between the blend and the fluids displaced from within the reservoir. As a result of the reduced viscosity contrast, the mobility of the resulting blend is reduced and viscous fingering within the reservoir is minimized.

Another objective of the present disclosure is to utilize a small concentration of an organic solvent that has very low solubility in both hydrocarbons and water within a subterranean geological formation. Using an organic solvent such as triethyl citrate during enhanced oil recovery allows the organic solvent to be recovered by simple mechanical separation and reused and thus, using triethyl citrate can be financially beneficial.

SUMMARY OF THE INVENTION

The present disclosure is related to a technique used for mitigating gas override in oil reservoirs. More specifically, the method of the present disclosure involves blending a displacement fluid, such as supercritical carbon dioxide, with an organic solvent, such as triethyl citrate, to increase the density and viscosity of the displacement fluid. Depending on the reservoir pressure and temperature, a relatively small concentration of the organic solvent is required and the mixing of the organic solvent can be completed at the surface before injection. The injection blend consisting of the organic solvent and supercritical carbon dioxide is pressurized to a pressure higher than the saturation pressure of the injection blend such that the injection blend remains in a single phase fluid when within the oil reservoir. When preparing the injection blend is complete, the injection blend is injected into the oil reservoir through injection wells.

An organic solvent such as triethyl citrate which has very low solubility in both water and crude oil is preferably used. Thus, the organic solvent can be recovered from the liquids produced from the reservoir through simple mechanical separation techniques. The organic solvent can also be separated from the produced gases at low separation pressures and temperatures so that the organic solvent can be reused.

As a result, the effect of gravity override is minimized and a volume of the reservoir contacted by the gas during gas flooding is increased. Even though the method of the present disclosure is described with carbon dioxide and triethyl citrate, the method of the present disclosure can be implemented with other comparable gases and organic solvents as well.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

All illustrations of the drawings are for the purpose of describing selected versions of the present disclosure and are not intended to limit the scope of the present disclosure.

Figure 1:
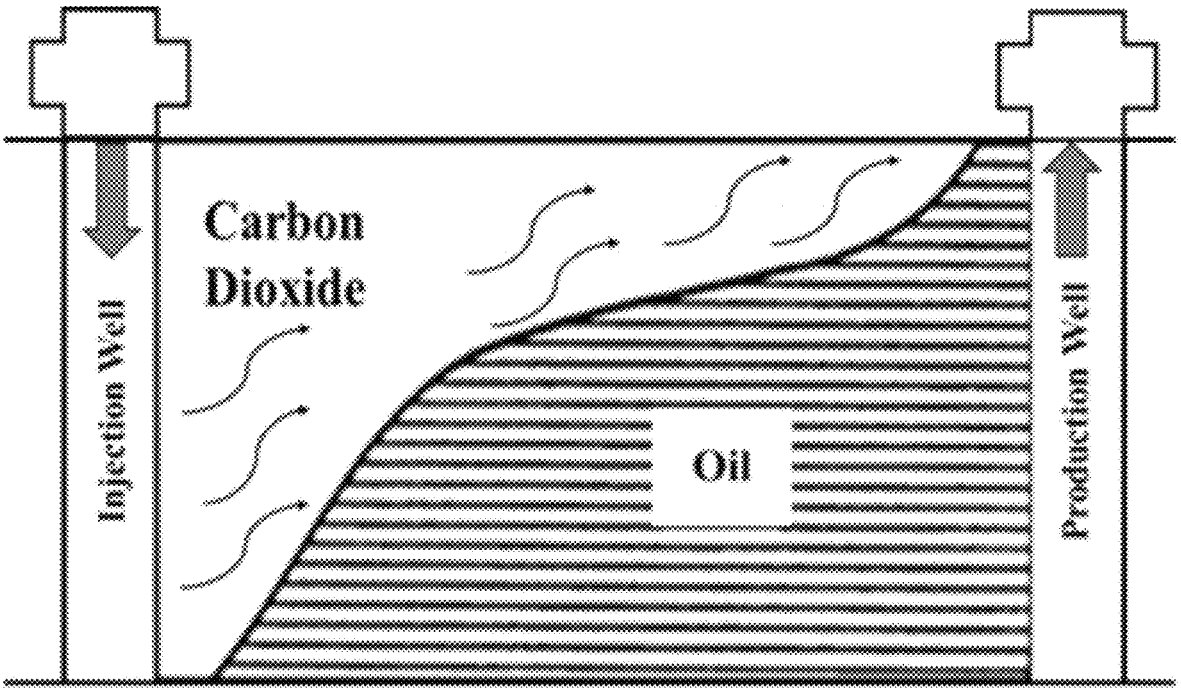
FIG. 1 is an illustration of gravity override when carbon dioxide is injected into a hydrocarbon reservoir as a neat fluid.

Gravity override is a phenomenon where a less dense fluid flows preferentially at the top of a hydrocarbon reservoir and a more dense fluid flows at the bottom. As illustrated in FIG. 1 as a result of gravity override, an injected gas/liquid bypasses a significant portion of the hydrocarbon reservoir volume resulting in poor reservoir sweep efficiency, wherein the reservoir sweep efficiency is a metric for the overall volume of the hydrocarbon reservoir contacted by the injected gas. The poor reservoir sweep efficiency leads to smaller incremental oil recovery. The present disclosure describes a method that can be used to mitigate gravity override in a hydrocarbon reservoir by improving sweep efficiency and thus, lead to improved oil recovery.

The method described in the present disclosure is implemented on a production system that includes at least one injection well and at least one production well that are in fluid communication with a hydrocarbon reservoir (e.g., a subterranean geologic formation that contains a hydrocarbon reservoir). In order to establish a connection path to the hydrocarbon reservoir, a mixing vessel is also in temporary fluid communication with at least one injection well. In one embodiment, the mixing vessel can be in fluid communication with at least one injection well through a set of fluid pipes. In another embodiment, the mixing vessel can be in fluid communication with the at least one injection well through an in-line mixing mechanism. The mixing vessel is used to conduct mixing at ambient temperature in a pressurized environment. As is required in all engineering designs, surface equipment such as the mixing vessel, and well components are designed for the anticipated operating pressures. This constraint translates into selecting the appropriate casing and tubing grade and weight/thickness to avoid wellbore collapse. Economically, it is preferable to use carbon steel components, as opposed to exotic alloys or clad materials for well construction, whenever possible. However, in carbon dioxide oil recovery applications, due to the combined presence of carbon dioxide and water, carbon steel (subject to direct exposure to injected or produced fluids) must be either coated or lined with appropriate materials to prevent corrosion. For example, tubing strings exposed to wet carbon dioxide typically have a coating of plastic, epoxy, or glass reinforced epoxy as a protective liner.

As an initial step, an injection blend is formed by mixing the displacement fluid with an organic solvent in the mixing vessel. The mixing vessel can be a cylindrical horizontal tank into which the displacement fluid is fed continuously. The organic solvent is stored in a container placed next to the mixing vessel. A pump transfers the organic solvent from its storage container to the mixing vessel through an injection port at the upstream end of the mixing vessel. The organic solvent is dozed into the mixing vessel at a rate that is proportional to the flow rate of the displacement fluid through the mixing vessel such that the resulting blend has the required composition. Baffles and sieves fitted inside the mixing vessel facilitate complete blending of the organic solvent with the displacement fluid as the mixture passes through the mixing vessel. A flowline connecting the mixing vessel to the injection wellhead assembly delivers the blend to the injection well's tubing.

In a preferred embodiment of the method described in the present disclosure, the displacement fluid is supercritical carbon dioxide. However, in different embodiments of the method described in the present disclosure, the displacement fluid can be selected from the group consisting of carbon dioxide, flue gas, methane, ethane, propane, butane, nitrogen, and combinations thereof. In a different embodiment of the method described in the present disclosure, steam also can be used as the displacement fluid. Moreover, in a preferred embodiment of the method described in the present disclosure, triethyl citrate is selected as the organic solvent due to its very low solubility in fluids within the hydrocarbon reservoir. Preferably, the organic solvent is selected to be insoluble in the fluids within the hydrocarbon reservoir. Even though triethyl citrate is used in a preferred embodiment, other comparable organic solvents can also be used in other embodiments of the method described in the present disclosure. For example, tributyl citrate, acetyl tributyl citrate, acetyl triethyl citrate or other esters of citric acid as well as ethyl benzoate can be used in other embodiments of the method described in the present disclosure. The injection blend, which is preferably a mix of supercritical carbon dioxide and triethyl citrate, functions as the displacing fluid of the oil recovery process, whereas the crude oil within the hydrocarbon reservoir is the displaced fluid.

Certain conditions are preferably satisfied when injecting the displacement fluid into the hydrocarbon reservoir. As a first injection condition, the displacement fluid needs to be present as a dense fluid. Since carbon dioxide prevails as a dense fluid in the supercritical state, using supercritical carbon dioxide fulfills the first injection condition. In particular, the carbon dioxide is injected so that under the conditions which prevail in the reservoir carbon dioxide is present in a dense phase, wherein under supercritical conditions carbon dioxide is present as neither a liquid nor a dense vapor. Generally, this will be achieved by maintaining pressure in the reservoir sufficiently high to maintain the carbon dioxide in the desired dense-phase state. i.e. at a density greater than approximately 0.4 g/cm$^3$. More specifically, carbon dioxide behaves as a supercritical fluid above its critical temperature (304.25 kelvin (K), 31.10 centigrade (° C.), 87.98 fahrenheit (° F.)) and critical pressure (72.9 atmospheric pressure (atm), 7.39 Megapascal (MPa), 1,071 pounds per square inch (psi), 73.9 bar), expanding to fill its container like a gas but with a density like that of a liquid. The minimum pressure necessary to maintain the dense-phase state increases with increasing reservoir temperature; the pressure should therefore be chosen in accordance with the reservoir temperature. Typical minimum pressures for maintaining the dense-phase state are 900 pound per square inch absolute (psia) at 85° F., 1200 psia at 100° F., 1800 psia at 150° F., 2500 psia at 200° F. and 3100 psia at 250° F. (6205 kPa at 30° C., 8275 kPa at 38° C., 12410 at 65° C., 17235 kPa at 93° C., 21375 kPa at 120° C.).

Preferably, the organic solvent is mixed with supercritical carbon dioxide at the surface at surface temperature and pressurized to an injection pressure, wherein the injection pressure is greater than a saturation pressure of the injection blend. As a result, the injection blend, which is a mix of both supercritical carbon dioxide and triethyl citrate, will also be a single-phase dense fluid.

As a second injection condition, a minimum miscibility pressure (MMP) of supercritical carbon dioxide is preferably considered, wherein the MMP is the pressure at and above which miscible recovery of reservoir oil can be achieved by carbon dioxide displacement. MMP depends on crude oil composition and reservoir conditions, and is typically determined using slim tube tests. In particular, the MMP is defined as the pressure at which more than 80% of the original oil-in-place (OOIP) is recovered at carbon dioxide breakthrough. On an industrial scale, an oil recovery of 90% at 1.2 pore volumes of carbon dioxide injected is used as a rule of thumb for estimating MMP. At a temperature of 80° C., the MMP is about 2,500 psi for light crudes and can be as high as 4,000 psi for heavy crude oils. At such pressures carbon dioxide will be in the super critical state. Preferable ranges for MMP are from 2,800 to 3,800 psi, 3,000 to 3,500 psi or about 3,200 psi. In particular, if a pressure value within the hydrocarbon reservoir is greater than the MMP of supercritical carbon dioxide, the supercritical carbon dioxide will be miscible with a volume of oil from the hydrocarbon reservoir. On the other hand, if the pressure value within the hydrocarbon reservoir is lower than the MMP of supercritical carbon dioxide, the injection pressure is selected to be greater than the MMP of supercritical carbon dioxide. However, the injection pressure is monitored such that the injection pressure does not approach a fracture pressure of the hydrocarbon reservoir since the fracture pressure can cause a rock formation to fracture hydraulically.

The displacement fluid and the organic solvent are selected such that the displacement fluid completely blends with the organic solvent. When the organic solvent is completely mixed with supercritical carbon dioxide, the density and the viscosity of the injection blend, which is a dense single phase liquid, is greater than the viscosity and the density of supercritical carbon dioxide. When only supercritical carbon dioxide is used, if a temperature of the hydrocarbon reservoir is 80-centigrade (° C.), the density of supercritical carbon dioxide ranges between 221.6 kilogram (kg)/cubic meter (m$^3$) at a pressure of 100 bar to 594 kg/m$^3$ at a pressure of 200 bar. At the same temperature of 80° C., the density of a quantity of oil from within the hydrocarbon reservoir can be between 780 and 890 kg/

Since the density value of the supercritical carbon dioxide alone is low compared to the typical density value of the oil, gravity segregation occurs and overall oil recovery is reduced. The organic solvent is used to alter the density value of the injection blend that is inserted into the hydrocarbon reservoir. In order to do so, the organic solvent must have a density value that increases the overall density of the injection blend. For example, triethyl citrate used in a preferred embodiment of the method described in the present disclosure has a density value of 1.14 g/cm$^3$ at 25° C.

By using triethyl citrate as the organic solvent, a substantially small concentration can be used to alter/increase the viscosity and the density of the displacement fluid. In a preferred embodiment, a molar ratio between the organic solvent and the displacement fluid within the injection blend is approximately 1:9. In another embodiment, the molar ratio between the the organic solvent and the displacement fluid within the injection blend can be 1.5:8.5. In another embodiment, the molar ratio between the organic solvent and the displacement fluid within the injection blend can be 2:8 or about 3:7, preferably 4:6. More specifically, the organic solvent is selected such that a pressure of the injection blend within the hydrocarbon reservoir at an internal hydrocarbon reservoir temperature is greater than a vapor pressure of the organic solvent at the internal hydrocarbon reservoir temperature. For example, a pressure value of the injection blend at 80° C. needs to be greater than the vapor pressure of the organic solvent at 80° C. Even though a molar ratio of 1:9 is described in the present disclosure, other comparable ratios can also be used in other embodiments of the method described in the present disclosure.

Figure 3:
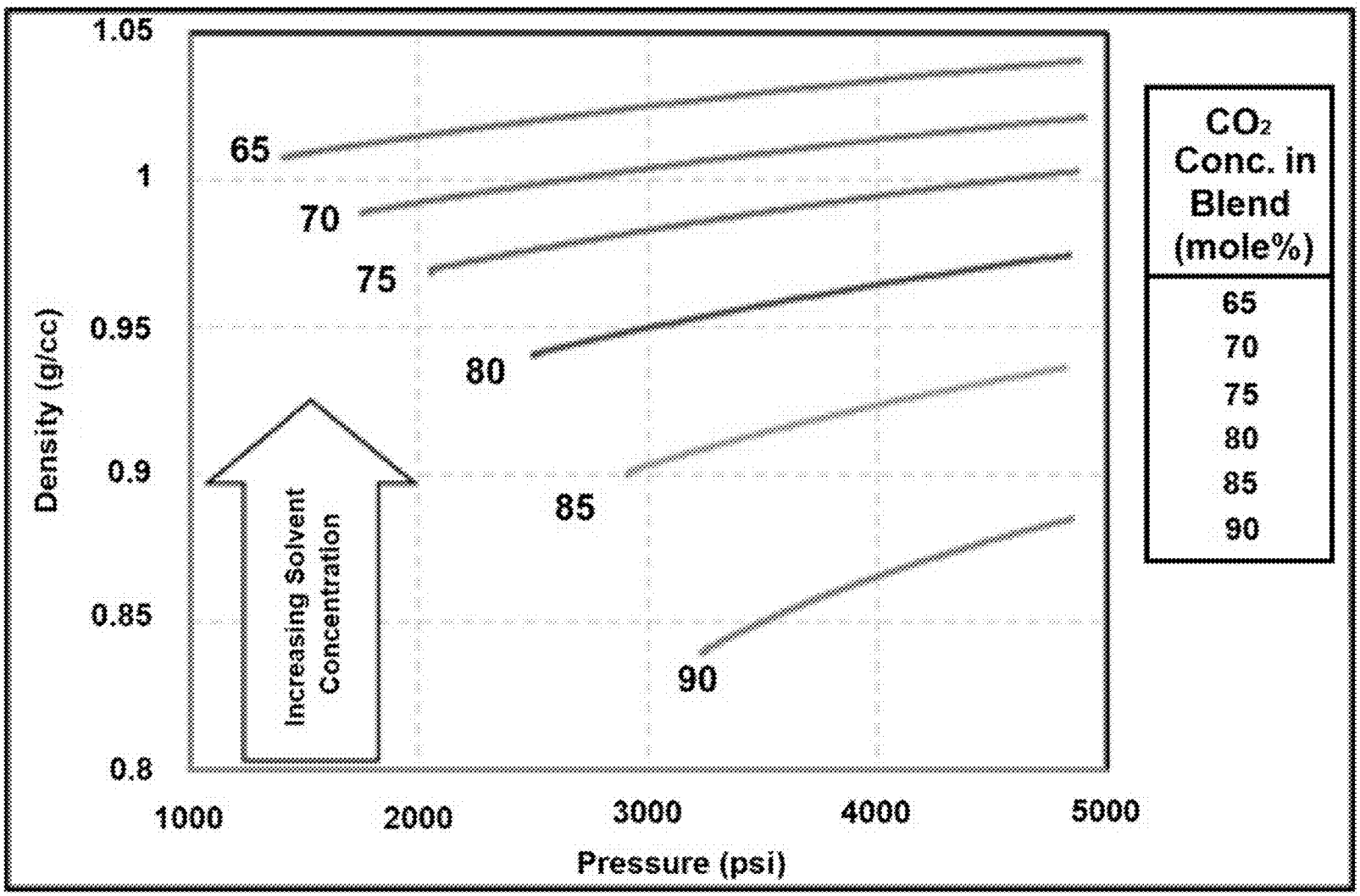
FIG. 3 is a graph illustrating six supercritical carbon dioxide and triethyl citrate injection blends, wherein the injection blends are at 100° C. and varying pressures.

Since the overall volume of the organic solvent used within the injection blend is relatively low, using the organic solvent for mitigating gravity override can be financially and operationally beneficial compared to other gravity override mitigating methods. Based upon the 1:9 molar ratio, when triethyl citrate and supercritical carbon dioxide are used, the injection blend contains 10 mole percent (mole %) of triethyl citrate and 90 mole % of supercritical carbon dioxide based on the molar total amount of triethyl citrate and supercritical carbon dioxide. As a result, the injection blend will have a density of 0.84 gran/cubic centimeter (g/cm$^3$) (840 kg/m$^3$) at a saturation pressure of approximately 3200 pounds per square inch (psi) at 100° C. In another instance, 15 mole % of triethyl citrate and 85 mole % of supercritical carbon dioxide can be used such that the density of the injection blend is 0.90 g/cm$^3$ (900 kg/m$^3$) at a saturation pressure of approximately 2900 psi at 100° C. At the same temperature of 100° C., a density of oil from within the hydrocarbon reservoir can be between 760 and 870 kg/m$^3$. Therefore, the density of the injection blend is substantially comparable with the density of the oil from the hydrocarbon reservoir. FIG. 3 is an illustration of the density variation of the injection blend at varying pressures.

Figure 2:
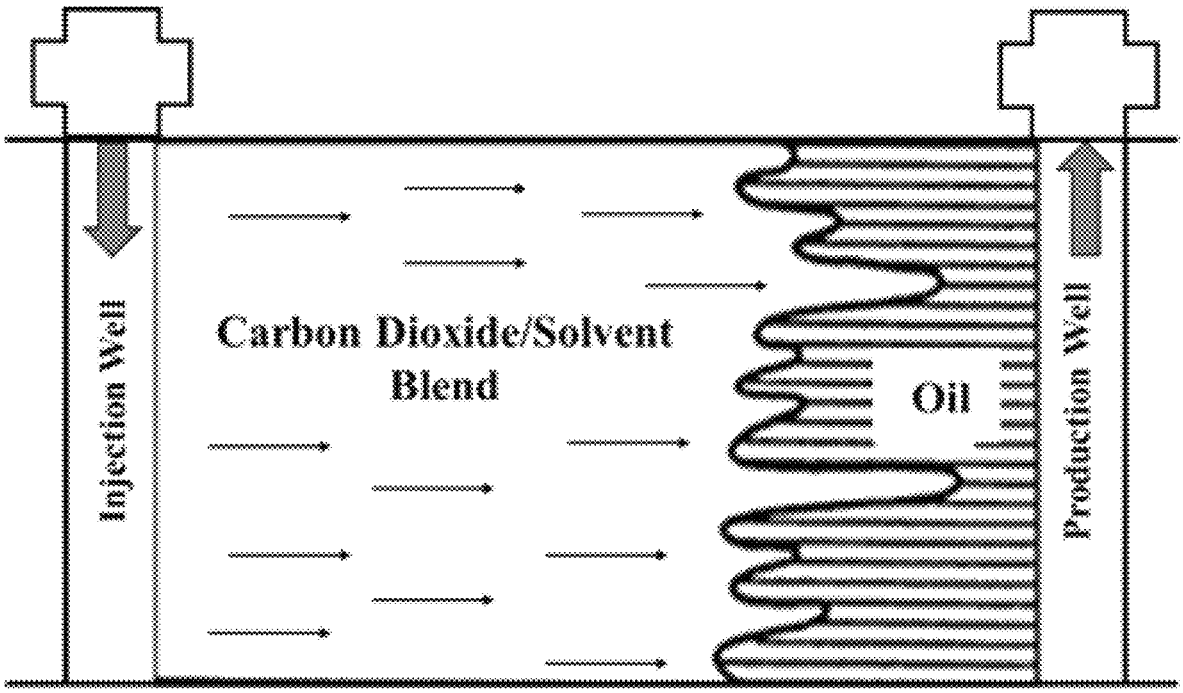
FIG. 2 is an illustration of how blending carbon dioxide with a solvent can improve vertical sweep efficiency leading to better oil recovery.

As illustrated in FIG. 2 as a result of the high density and viscosity values of the injection blend, when the injection blend is transferred from the mixing vessel into the hydrocarbon reservoir through the at least one injection well, viscous fingering, wherein a more viscous fluid is displaced by a less viscous fluid, is reduced within the hydrocarbon reservoir. Moreover, the reduction in the density difference minimizes the tendency the injection blend has to rise to the top of the hydrocarbon reservoir. Thus, the effect of gravity override is also minimized by blending supercritical carbon dioxide with an organic solvent such as triethyl citrate and the overall volume of the hydrocarbon reservoir contacted by the injection blend is increased. As a result, a more efficient oil recovery process is conducted.

As described earlier, the method of the present disclosure is used with at least one injection well and at least one production well that are in fluid communication with the hydrocarbon reservoir. The at least one injection well is utilized to transfer the injection blend into the hydrocarbon reservoir. On the other hand, the at least one production well is utilized to extract a resulting injection blend as well as other displaced reservoir fluids from the hydrocarbon reservoir. In particular, the leading edge of the resulting injection blend comprises the injection blend with a volume of hydrocarbons extracted from the hydrocarbon reservoir while the bulk of the injection blend is produced intact. Therefore, when the resulting injection blend is removed at the at least one production well, the organic solvent can be separated from the resulting injection blend using a separation module. The insolubility of the organic solvent with the oil in the hydrocarbon reservoir is essential to perform the separation process. To do so, the separation module is preferably operatively engaged with the at least one production well. Since the organic solvent is insoluble in the displaced oil from the hydrocarbon reservoir, the separation process can be performed through a typical gas/liquid separator in one embodiment of the method of the present disclosure. Since the organic solvent can be completely separated from the resulting injection blend at a low separation pressure, the organic solvent can be reused.

In general, the at least one injection well and the at least one production well are positioned at a predetermined distance from each other. Even though only one injection well and only one production well are described in the present disclosure, the method of the present disclosure can be implemented with a plurality of injection wells and a plurality of production wells. In such embodiments, the injection blend will be transferred into the hydrocarbon reservoir through one or more injection wells. On the other hand, the produced reservoir fluids along with the resulting injection blend are extracted through one or more of the production wells. Moreover, the set of injection wells and the set of production wells can be configured to a five-spot configuration or any other injection/production pattern as deemed suitable to the nature of the hydrocarbon-bearing geological formation and the properties of the rock and fluids within the said formation.

As described earlier, in addition to being insoluble in the oil contained in the hydrocarbon reservoir, the organic solvent preferably has a high boiling point. The high boiling point helps the organic solvent to remain in a liquid phase at high temperatures. Furthermore, the organic solvent preferably has low flammability and low vapor pressure at ambient temperatures.

Figure 4:
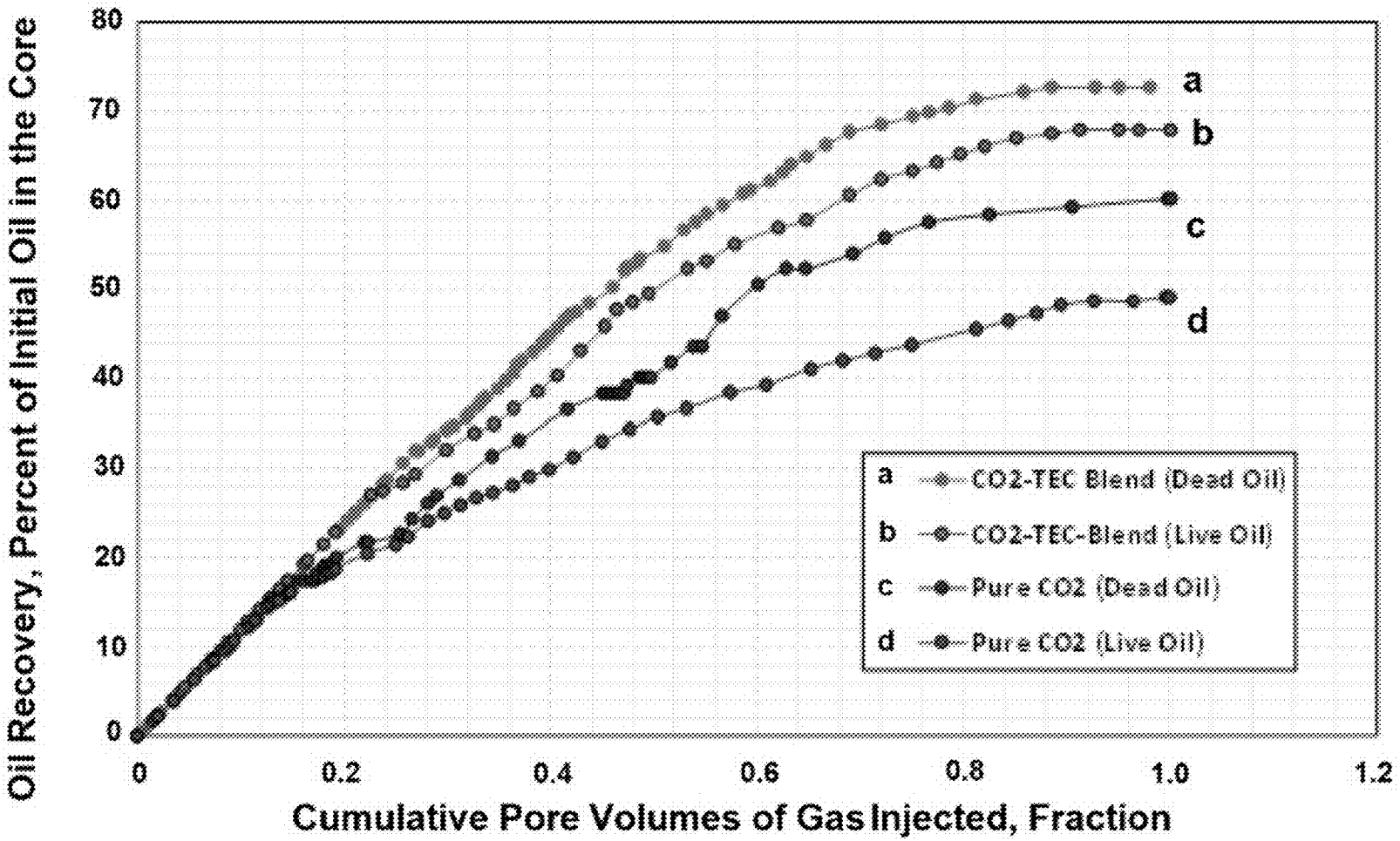
FIG. 4 is a graph illustrating improvements in oil recovery when a porous rock sample saturated with crude oil (dead or alive) is flooded vertically upwards with carbon dioxide (pure or blended with triethyl citrate).

As illustrated in FIG. 4, the effectiveness of the method described in the present disclosure is seen when four experiments were conducted on a porous rock sample that is 12-inches long and 1.5-inches in diameter. The porous rock sample was first saturated with degassed crude oil (dead oil) and then flooded vertically upward with pure carbon dioxide. The flooding pressure and temperature were 3500 PSIA and 100° C. respectively. The test was then repeated with a blend of carbon dioxide and triethyl citrate and a significant increase in oil recovery was observed. When the test was repeated with gas-saturated crude oil (live oil), similar improvements were observed when carbon dioxide was used with triethyl citrate.

Terminology. Terminology used herein is for the purpose of describing particular embodiments only and is not intended to be limiting of the invention.

The headings (such as "Background" and "Summary") and sub-headings used herein are intended only for general organization of topics within the present invention, and are not intended to limit the disclosure of the present invention or any aspect thereof. In particular, subject matter disclosed in the "Background" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

As used herein, the singular forms "a", "an" and "the" are intended to include the plural forms as well, unless the context clearly indicates otherwise.

It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

As used herein, the term "and/or" includes any and all combinations of one or more of the associated listed items and may be abbreviated as "1".

Links are disabled by deletion of http: or by insertion of a space or underlined space before www. In some instances, the text available via the link on the "last accessed" date may be incorporated by reference.

As used herein in the specification and claims, including as used in the examples and unless otherwise expressly specified, all numbers may be read as if prefaced by the word "substantially", "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), +/−15% of the stated value (or range of values), +/−20% of the stated value (or range of values), etc. Any numerical range recited herein is intended to include all subranges subsumed therein.

Disclosure of values and ranges of values for specific parameters (such as temperatures, molecular weights, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that parameter X may have a range of values from about A to about Z.

Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10 it also describes subranges for Parameter X including 1-9, 1-8, 1-7, 2-9, 2-8, 2-7, 3-9, 3-8, 3-7, 2-8, 3-7, 4-6, or 7-10, 8-10 or 9-10 as mere examples. A range encompasses its endpoints as well as values inside of an endpoint, for example, the range 0-5 includes 0, >0, 1, 2, 3, 4, <5 and 5.

As used herein, the words "preferred" and "preferably" refer to embodiments of the technology that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the technology.

As referred to herein, all compositional percentages are by weight of the total composition, unless otherwise specified. As used herein, the word "include," and its variants, is intended to be non-limiting, such that recitation of items in a list is not to the exclusion of other like items that may also be useful in the materials, compositions, devices, and methods of this technology. Similarly, the terms "can" and "may" and their variants are intended to be non-limiting, such that recitation that an embodiment can or may comprise certain elements or features does not exclude other embodiments of the present invention that do not contain those elements or features.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings of the present invention.

Spatially relative terms, such as "under", "below", "lower", "over", "upper", "in front of" or "behind" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

The description and specific examples, while indicating embodiments of the technology, are intended for purposes of illustration only and are not intended to limit the scope of the technology. Moreover, recitation of multiple embodiments having stated features is not intended to exclude other embodiments having additional features, or other embodiments incorporating different combinations of the stated features. Specific examples are provided for illustrative purposes of how to make and use the compositions and methods of this technology and, unless explicitly stated otherwise, are not intended to be a representation that given embodiments of this technology have, or have not, been made or tested.

Obviously, numerous modifications and variations of the present disclosure are possible in light of the above teachings. It is therefore to be understood that within the scope of the appended claims, the invention may be practiced otherwise than as specifically described herein.

The invention claimed is:

1. A solvent-assisted method for recovering hydrocarbons present in a hydrocarbon reservoir in a geologic formation, comprising:

mixing carbon dioxide with an organic solvent in a mixing vessel to form an injection blend, wherein the organic solvent is selected from the group consisting of triethyl citrate, tributyl citrate, acetyl tributyl citrate, and acetyl triethyl citrate;

transferring the injection blend from the mixing vessel into at least one injection well accessing the hydrocarbon reservoir of the geologic formation and injecting the injection blend into the hydrocarbon reservoir, wherein the injection blend is pressurized to a pressure higher than a saturation pressure of the injection blend such that the injection blend is a single phase fluid within the hydrocarbon reservoir;

extracting production fluids from the hydrocarbon reservoir through at least one production well accessing the hydrocarbon reservoir of the geologic formation, wherein the production fluids comprise a volume of hydrocarbons displaced from the hydrocarbon reservoir, a portion of the injection blend mixed with a volume of hydrocarbons extracted from the reservoir and the bulk of the injection blend; and separating the organic solvent from a resulting injection blend through a separation module, wherein the separation module is operatively engaged with the at least one production well;

wherein the at least one injection well and at least one production well are in fluid communication with the hydrocarbon reservoir;

wherein the mixing vessel is in fluid communication with the at least one injection well.

2. The solvent-assisted method for recovering hydrocarbons present in a hydrocarbon reservoir in a geologic formation as claimed in claim 1, wherein the carbon dioxide is supercritical carbon dioxide.

3. The solvent-assisted method for recovering hydrocarbons present in a hydrocarbon reservoir in a geologic formation as claimed in claim 1, wherein the organic solvent is triethyl citrate.

4. The solvent-assisted method for recovering hydrocarbons present in a hydrocarbon reservoir in a geologic formation as claimed in claim 1, wherein the organic solvent is insoluble in the hydrocarbons contained in the hydrocarbon reservoir.

5. The solvent-assisted method for recovering hydrocarbons present in a hydrocarbon reservoir in a geologic formation as claimed in claim 1, wherein the at least one injection well and the at least one production well are configured in a five-spot configuration.

6. The solvent-assisted method for recovering hydrocarbons present in a hydrocarbon reservoir in a geologic formation as claimed in claim 1, wherein a density of the injection blend is substantially equal to a density of a quantity of oil of the hydrocarbon reservoir.

7. The solvent-assisted method for recovering hydrocarbons present in a hydrocarbon reservoir in a geologic formation as claimed in claim 1, wherein a ratio between a volume of organic solvent and a volume of the carbon dioxide in the injection blend is approximately 1:9.

8. The solvent-assisted method for recovering hydrocarbons present in a hydrocarbon reservoir in a geologic formation as claimed in claim 1, wherein a ratio between a volume of organic solvent and a volume of the carbon dioxide in the injection blend is approximately 2:8.

9. The solvent-assisted method for recovering hydrocarbons present in a hydrocarbon reservoir in a geologic formation as claimed in claim 1, wherein the carbon dioxide completely blends with the organic solvent during the mixing.

* * * * *